US008256502B2

(12) United States Patent
Kawaguchi et al.

(10) Patent No.: US 8,256,502 B2
(45) Date of Patent: Sep. 4, 2012

(54) HEAT EXCHANGE MEMBER AND HEAT EXCHANGE APPARATUS

(75) Inventors: Touru Kawaguchi, Kariya (JP); Eiichi Torigoe, Anjo (JP); Yasumasa Hagiwara, Kariya (JP); Yoichiro Matsumoto, Tokyo (JP); Gota Kikugawa, Tokyo (JP); Taisuke Sugii, Tokyo (JP)

(73) Assignee: Denso Corporation, Kariya (JP)

( * ) Notice: Subject to any disclaimer, the term of this patent is extended or adjusted under 35 U.S.C. 154(b) by 1127 days.

(21) Appl. No.: 12/156,680

(22) Filed: Jun. 4, 2008

(65) Prior Publication Data

US 2008/0302517 A1 Dec. 11, 2008

(30) Foreign Application Priority Data

Jun. 8, 2007 (JP) ..... 2007-153112

(51) Int. Cl.
*F28F 13/18* (2006.01)
*F28F 7/00* (2006.01)

(52) U.S. Cl. ..... 165/133; 165/80.4

(58) Field of Classification Search ..... 165/133, 165/80.4, 185; 361/699, 714; 257/714
See application file for complete search history.

(56) References Cited

U.S. PATENT DOCUMENTS

| | | | | |
|---|---|---|---|---|
| 3,842,474 | A * | 10/1974 | Schladitz | 29/890.03 |
| 4,485,429 | A * | 11/1984 | Mittal | 361/718 |
| 4,593,661 | A * | 6/1986 | Brander | 123/196 AB |
| 6,080,243 | A | 6/2000 | Insley et al. | |
| 6,191,944 | B1 * | 2/2001 | Hammel et al. | 361/699 |
| 6,300,395 | B1 | 10/2001 | Sako et al. | |
| 6,835,453 | B2 | 12/2004 | Greenwood et al. | |
| 2006/0270116 | A1 * | 11/2006 | Dangelo | 438/122 |
| 2007/0121299 | A1 * | 5/2007 | Campbell et al. | 361/710 |
| 2007/0256810 | A1 * | 11/2007 | Di Stefano et al. | 165/46 |

FOREIGN PATENT DOCUMENTS

| | | |
|---|---|---|
| EP | 0744587 | 11/1996 |
| JP | 05-240595 | 9/1993 |
| JP | 06-147784 | 5/1994 |
| JP | 09-79791 | 3/1997 |
| JP | 11-337294 | 12/1999 |
| JP | 2000-024512 | 1/2000 |
| JP | 2000-239895 | 9/2000 |
| JP | 2000-264874 | 9/2000 |
| JP | 2001-152363 | 6/2001 |
| JP | 2002-518661 | 6/2002 |

(Continued)

OTHER PUBLICATIONS

Office action dated Sep. 13, 2011 in corresponding Japanese Application No. 2007-153112.

*Primary Examiner* — Tho V Duong
(74) *Attorney, Agent, or Firm* — Harness, Dickey & Pierce, PLC

(57) ABSTRACT

A heat exchange member comprising a liquid layer and a solid layer capable of conducting a heat exchange reaction with the liquid layer upon their solid-liquid contact at an interface between the solid layer and the solid layer, wherein the solid layer further comprises on a surface thereof which is contacted with the liquid layer a surface coating layer capable of reducing a difference of the vibration between a thermal vibration of the solid and a thermal vibration of the liquid, and the surface coating layer comprises a plurality of fibrous structures arranged on a surface of the solid layer, and a heat exchange apparatus using the heat exchange member.

16 Claims, 6 Drawing Sheets

FOREIGN PATENT DOCUMENTS

| | | |
|---|---|---|
| JP | 2002-256446 | 9/2002 |
| JP | 2003-321554 | 11/2003 |
| JP | 2004-518294 | 6/2004 |
| JP | 2006-078134 | 3/2006 |
| JP | 2006-299272 | 11/2006 |
| JP | 2006-527912 | 12/2006 |

* cited by examiner

HEAT EXCHANGE MEMBER AND HEAT EXCHANGE APPARATUS

BACKGROUND OF THE INVENTION

1. Field of the Invention

The present invention relates to a heat exchange member having an improved cooling performance capable of being advantageously used in an air conditioner and other heat exchange apparatuses, and a heat exchange apparatus using the same. The heat exchange apparatus of the present invention can be advantageously used in air conditioners of automobiles.

2. Description of the Related Art

As is well known, heat exchange apparatuses based on a solid-liquid contact reaction are improved in order to improve their heat exchange efficiency and other properties. For example, the improvement in these apparatuses is widely carried out, for example, by attaching fins to the heat exchange apparatus, thereby increasing a contact area of the solid-liquid contact reaction, or applying a surface treatment to or a surface coating to fins or other members, thereby improving a hydrophilic property or an antibacterial property. For example, Japanese Unexamined Patent Publication (Kokai) No. 2006-78134 teaches the formation of a hydrophilic coating having an antibacterial and mildew-proofing property in a substrate of aluminum or an alloy thereof used as a fin member of the heat exchanger, thereby ensuring to maintain an excellent antibacterial and mildew-proofing function for an extended period of time. Further, Japanese Unexamined Patent Publication (Kokai) No. 2006-299272 teaches the treatment of a surface of the aluminum-containing metal material constituting a heat exchanger with an aqueous treating agent comprising (A) a water-soluble organic compound, (B) a water-soluble polymeric compound having a hydrophilic functional group and/or a water-soluble compound having a hydrophilic functional group and capable of being converted to the corresponding polymeric compound, and (C) an antibacterial agent, thereby ensuring to produce a polymeric coating having a hydrophilicity, a property of preventing odor generation and an antibacterial property.

SUMMARY OF THE INVENTION

The inventors of this application have made a careful study to provide a method of further improving a cooling performance of the heat exchanger and others, and have found that if it is intended to improve a cooling performance of the heat exchanger through the solid-liquid contact reaction between the solid layer and the liquid layer of the heat exchanger, application of a surface treatment layer or a surface coating layer onto a surface of the solid layer (solid heat-transferring surface) of the heat exchanger as in the prior art method is considered to be effective, but a thermal resistance created in the solid-liquid interface of the solid surface can be adversely affected on the resulting cooling performance of the heat exchanger.

Then, the above problem due to the thermal resistance will be described referring to FIG. 1. As is illustrated in FIG. 1(B), the prior art heat exchanger comprises a solid layer 101 (for example, as aluminum) constituting a body or surface portion of the heat exchanger, and a surface coating layer 102. The surface coating layer 102 can conduct a solid-liquid contact with a liquid layer 103 (for example, water) applied thereon. As a result of the solid-liquid contact reaction, as is shown in FIG. 1(A), a heat originated from an increased temperature of the solid layer 101 can be transferred through the surface coating layer 102 to the liquid layer 103, thereby ensuring to attain a desired cooling. However, during the illustrated heat transfer process, there arises one problem which is a maintenance of the same temperature due to the thermal resistance at the solid-liquid interface, as is shown with an arrow A in FIG. 1(A). That is, as a large level of thermal resistance is originally generated in an interface between the a solid of the solid layer 102 and a liquid of the liquid layer 103, the desired heat transfer function is adversely affected at a section of the interface and thus the undesired condition, i.e., an increased temperature, is maintained in the interface section without reduction of the temperature. In this connection, it should be noted that for the patent literatures described above, they do not describe the above problem caused due to the thermal resistance, as they teach only an increase of the cooling performance by the formation of a surface coating layer consisting of a polymeric coating on a surface of the solid layer to thereby improve a hydrophilicity of the solid layer with a liquid and thus improve a fluidity of the liquid.

The same problem will be remarkable caused in the prior art heat exchanger having no surface coating layer. This will be illustrated in FIG. 2 which shows a liquid layer 103 sandwiched between the adjacent solid layers 102. When the liquid layer 103 is displaced between the solid layers 103 as is shown in FIG. 2(B), a large thermal resistance "A" is generated between a solid of the solid layer 101 and a liquid of the liquid layer 103 as is shown in FIG. 2(A), and thus a largely increased temperature is maintained in an interface portion of the solid layer 101 and the liquid layer 103 as a result of an adversely affected heat transfer function at the interface portion. Note that the above results were obtained by the inventors by their simulation tests which were carried out to compare the prior art with the present invention and in which a gold (Au) layer and a toluene layer were used as the solid layer and as the liquid layer, respectively. As will be appreciated from FIG. 2(A), the simulation tests were carried out in such a manner that the right-sided solid layer 101 can exhibit an increased temperature.

Accordingly, the object of the present invention is to remove or at least inhibit a thermal resistance in an interface between a solid of the solid layer and a liquid of the liquid layer in a heat exchanger or similar heat exchanging apparatuses which are operated based on a solid-liquid contact process, thereby ensuring to attain a notably improved cooling efficiency.

The inventors have now found that the above object can be attained by applying the specified fibrous fibers onto a surface of the heat exchange member constituting the heat exchanger or similar heat exchange apparatuses, in place of applying a surface coating layer onto the surface of the heat exchange member, thereby improving a hydrophilicity and an antibacterial property, and forming the surface coating layer from a polymeric coating and others according to the prior art methods.

According to one aspect thereof, the present invention resides in a heat exchange member comprising a liquid layer and a solid layer capable of conducting a heat exchange reaction with the liquid layer upon their solid-liquid contact at an interface between the solid layer and the solid layer, wherein the solid layer further comprises, on a surface thereof which is contacted with the liquid layer, a surface coating layer capable of reducing a difference of the vibration between a thermal vibration of the solid and a thermal vibration of the liquid, and the surface coating layer comprises a plurality of fibrous structures aligned on a surface of the solid layer.

In addition, according to another aspect thereof, the present invention resides in a heat exchange apparatus provided with the heat exchange member according to the present invention.

According to the present invention, as will be appreciated from the following detailed descriptions of the present invention, as a laminar layer of the specified fibrous structures is aligned onto a surface of the solid layer of the heat exchange member, a constituting member of the heat exchange apparatuses, it becomes possible to remarkably reduce a thermal resistance in an interface portion between a solid of the solid layer and a liquid of the liquid layer in the heat exchange apparatuses to thereby effectively transfer a heat of the solid layer from the solid to the liquid, thus enabling to provide a notably increased cooling performance.

In addition, as the heat exchange member of the present invention can provide the notably increased cooling performance, it can be advantageously utilized in the production of a wide variety of heat exchange apparatuses including, for example, a heat exchanger for automobiles.

DESCRIPTION OF THE PREFERRED EMBODIMENTS

The heat exchange member and the heat exchange apparatus of present invention can be advantageously carried out in different embodiments. Hereinafter, the typical embodiments of the present invention will be described with reference to the accompanying drawings, but it should be noted that the present invention is not restricted to the illustrated embodiments.

The heat exchange member of the present invention further comprises a solid surface coating layer capable of moderating or reducing a difference of the vibration state between a thermal vibration of the solid and a thermal vibration of the liquid on a surface thereof. In addition, the surface coating layer further comprises a plurality of fibrous structures which were regularly disposed or aligned on a surface of the solid layer. The term "surface coating layer" used herein may be replaced with the term "surface protective layer" in view of its functions.

First, the constitution and functions of the heat exchange member according to the present invention, especially the constitution and functions of the surface coating layer thereof will be described referring to FIGS. 3 and 4.

Figure 3:
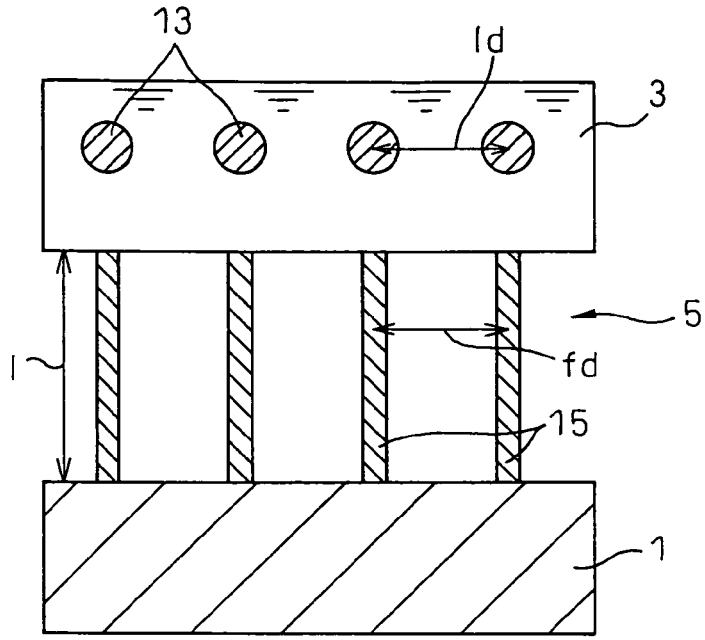
FIG. 3 is a cross sectional view of the heat exchanger according to the present invention showing the constitution and function of the heat exchanger.

FIG. 3 is a schematic cross-sectional view showing the relationship between the solid layer and the liquid layer. A plurality of fibrous structures 15 are fixedly attached to a solid layer 1 which is applied on a surface of heat exchanger (not shown). As a whole, the fibrous structures 15 are combined together to form one laminar structure or layer coating, i.e., a surface coating layer 5. Further, a liquid layer 3 is applied to the heat exchanger in such a manner the liquid layer 3 is contacted with the adjacent solid layer 1 to realize a solid-liquid contact between a solid of the solid layer 1 and a liquid of the liquid layer 3. The reference number 13 means liquid molecules constituting the liquid layer 3. It should be noted in FIG. 3 that for the illustration purpose, a surface of the liquid layer 3 is contacted only with a surface of the surface coating layer 5, but a liquid of the liquid layer 3 may be introduced into gaps formed between the adjacent fibrous fibers 15 constituting the surface coating layer 5.

In the present invention, as is described above, attention was made to the reduction in a difference of the vibration state between a thermal vibration of the solid and a thermal vibration of the liquid for the purpose of reducing a thermal resistance in a solid-liquid interface of the solid layer and the liquid layer. That is, this is because the inventors have found that a thermal resistance in the solid-liquid interface is caused mainly due to a difference of the vibration, based on a thermal vibration, between the solid and the liquid. Thus, according to the present invention, a thermal vibration can be remarkably reduced by coating a surface of the solid layer 1 with a layer 5 capable of reducing a difference of the vibration state (this layer is referred to as a "surface coating layer" in the present invention).

When vibration is transferred from the surface coating layer 5 formed on a surface of the solid layer 1 to a liquid in the liquid layer 3, it is necessary that a thermal vibration is caused at a liquid side of the surface coating layer 3 in such a level equivalent to that of the liquid molecules 13. In such an instance, as a state of the thermal vibration is determined depending upon an interaction between the molecules or between the atoms, it is necessary that the molecules constituting the liquid side of the surface coating layer 5 can exhibit an interaction which is equivalent to that of the liquid molecules 13. On the other hand, in order to transfer a vibration from the solid layer 1 to the surface coating layer 5 on the surface thereof, it is necessary that a solid side of the surface coating layer 5 is strongly fixed to a surface of the solid layer 1. In addition, it is preferred that the surface coating layer 5 is continuously extended from a solid side thereof to a liquid side, as is illustrated, without having interrupted portions.

Such a continuous extension of the surface coating layer 5 is effective to prevent a damping of the vibration during the transfer of the vibration in the surface coating layer 5.

In other words, to satisfy the requirements described above in an interface between the solid and the liquid, the present invention teaches coating a surface of the solid with a layer consisting of fibrous structures aligned as is illustrated. Moreover, it is preferred that the fibrous structures satisfy the following requirements.

1. One end of the fibrous structures 15 is fixed on a surface of the solid layer 1 and another end thereof is a free end and is contacting with the liquid layer 3.

2. The fibrous structures 15 are aligned independently each other on the solid layer 1.

3. An interaction between the adjacent fibrous structures 15 (interaction fd of the fibrous structures) is the same as or substantially the same as the interaction between molecules 13 of the liquid constituting the liquid layer 3 (interaction ld of the liquid molecules).

4. A length l of the fibrous structures 15 is identical or substantially identical with or is not less than an average intermolecular distance between molecules 13 of the liquid constituting the liquid layer 3.

Figure 4:
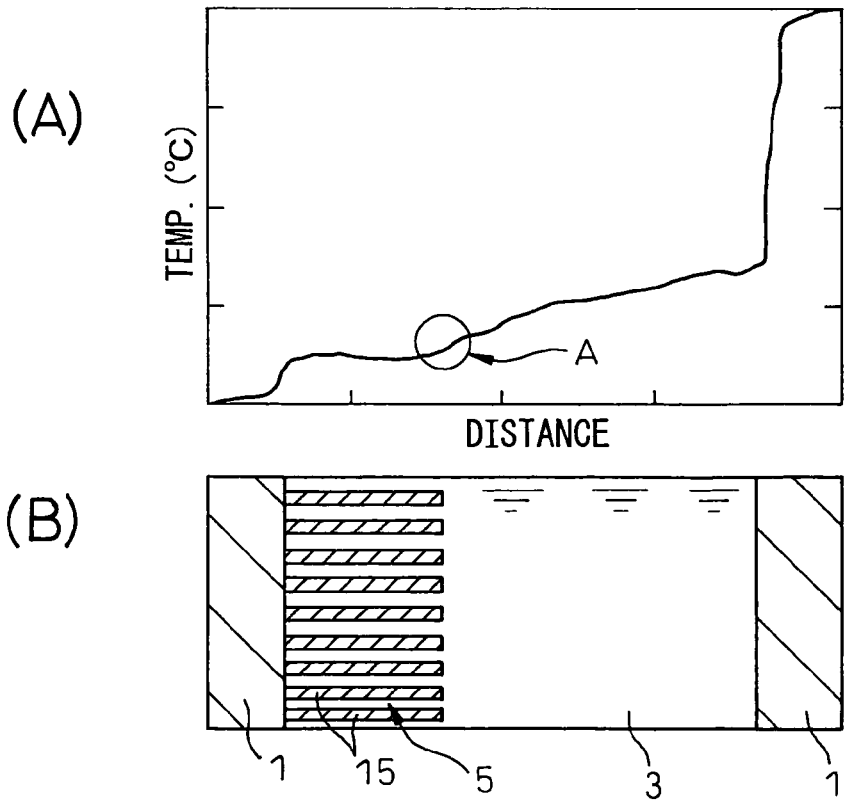
FIG. 4 is an illustration showing a cross section of the heat exchanger according to the present invention having a surface coating layer, along with a reduction of the thermal resistance in a solid-liquid interface of the heat exchanger.

The relationship between the solid layer and the liquid layer will be further described referring to FIG. 4.

FIG. 4(B) shows a constitution of the heat exchange member according to one preferred embodiment of the present invention in which a solid layer 1 and a liquid layer 3 each is laminar-wise disposed in such a manner that the liquid layer 3 is sandwiched between the adjacent solid layers 1, and one of the solid layers 1 has a solid surface coating layer 5 consisting of fibrous structures 15. Note in the illustrated heat exchange member that a gold (Au) layer, an alkanethiol layer and a toluene layer were used as the solid layer 1, as the surface coating layer 5 and as the liquid layer 3, respectively. Further, as will be appreciated from FIG. 4(A), the simulation tests were carried out in such a manner that the right-sided solid layer 1 can exhibit an increased temperature.

As a result of the simulation tests, a large thermal resistance was generated in the right-sided solid layer 1 having no surface coating layer (see, FIG. 4(A)), as is described above with reference to FIG. 2(A). However, contrary to the phenomenon in the right-sided solid layer 1, in a left-sided solid layer 1, as is shown in FIG. 4(A), a thermal resistance "A" could be reduced to a negligible level in an interface between a solid of the solid layer 1 and a liquid of the liquid layer 3. As a result, according to the present invention, the desired heat transfer function in an interface portion between the solid and the liquid could be attained without adverse effects on the heat transfer function, along with ensuring of the desired cooling performance. Moreover, it is considered that these excellent effects are originated from the following points.

In the heat exchange member described above, it is generally considered that the temperature can be proportional to a product of mass and square of a thermal vibration velocity. Thus, under the conditions of the same temperature, the thermal vibration velocity can be reduced with increase of the mass, and the thermal vibration velocity can be increased with reduction of the mass. Further, based on the above phenomenon, it is considered for the substances having different mass that the thermal vibration velocity of the substances be largely varied depending the mass thereof under the conditions of the same temperature. As a propagation of the heat is considered to be equivalent with a propagation of the thermal vibration velocity, it is also considered that the propagation of the heat can be adversely affected when the thermal vibration velocity is largely varied as in the interface between the solid and the liquid. On the contrary, it is also considered that if it is possible to realize the conditions under which a large variation of the thermal variation velocity can be prevented, it becomes possible to realize an effective propagation of the temperature without causing an inhibition of the propagation of the heat.

Next, based on the above considerations, the features of the simulation tests described above with reference to FIGS. 2 and 4 will be further studied.

Figure 1:
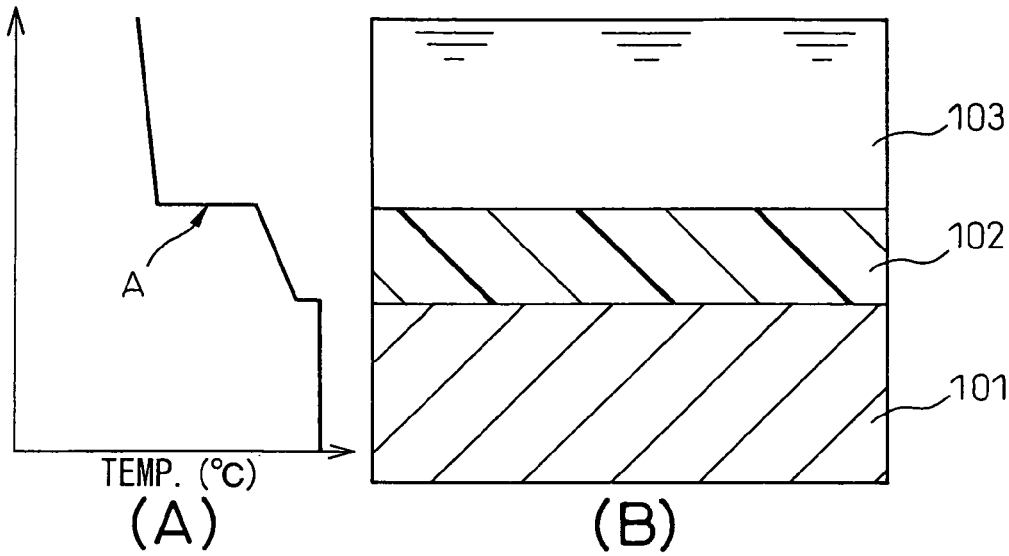
Fig.1 PRIOR ART
FIG. 1 is an illustration showing a cross section of the prior art heat exchanger having a surface coating layer, along with a variation of the thermal resistance in a solid-liquid interface of the heat exchanger.
Figure 2:
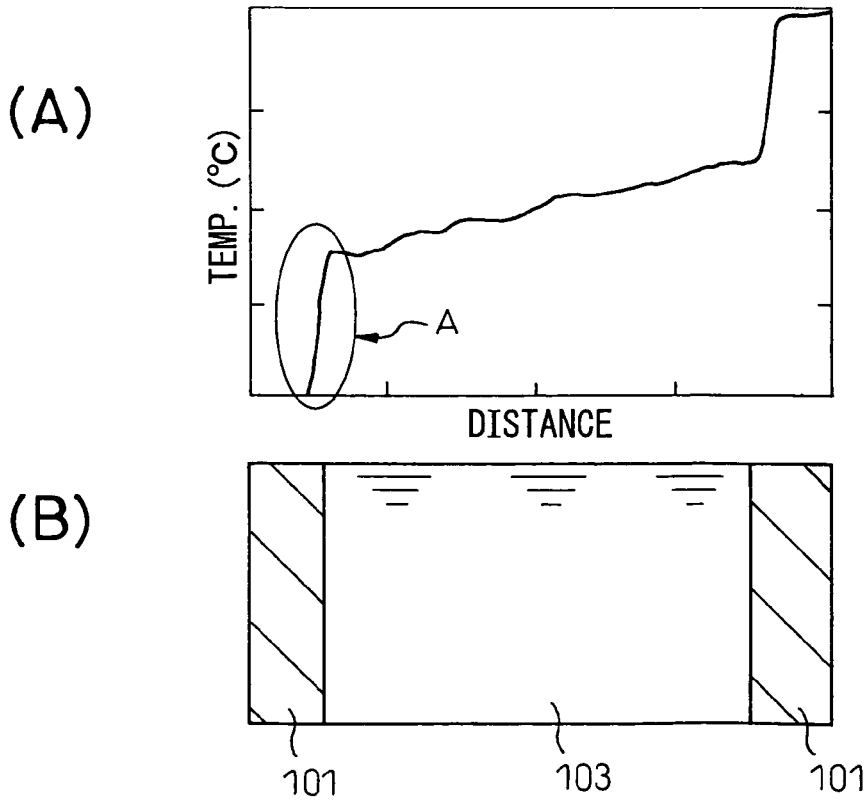
Fig.2 PRIOR ART
FIG. 2 is an illustration showing a cross section of the prior art heat exchanger having no surface coating layer, along with a variation of the thermal resistance in a solid-liquid interface of the heat exchanger.

Heat Exchange Member Having No Surface Coating Layer (See, FIG. 2)

A mass ratio of gold (Au) atom to toluene atom is large (Mw of Au: 193; Mw of carbon (C): 12)

Heat Exchange Member Having a Surface Coating Layer (See, FIG. 4)

There is a covalent bonding: Au—S formed in a bonding portion of the gold (Au) atom and the surface coating layer (alkanethiol).

A mass ratio of the atom of a tip portion of alkanethiol to a constitution atom of toluene molecule is substantially one (1), as the tip portion and the constitution atom each comprises a carbon atom.

The tip portion of alkanethiol has a high affinity with the toluene molecule.

Under the consideration of the above differences between the heat exchange member having no surface coating layer and the heat exchange member having a surface coating layer, it is considered that a reduction of the thermal resistance could be attained in the solid-liquid interface in the heat exchange member of the present invention illustrated in FIG. 4 on the following reasons.

(i) A constitution atom of the liquid molecule has a mass ratio which is approximate to that of an atom of the tip portion of the surface coating layer.

(ii) There is a high affinity between the liquid molecule and the tip portion of the surface coating layer. Thus, it becomes possible to adjust a thermal vibration of the liquid molecule and a thermal vibration of the tip portion of the surface coating layer to an approximately same value. In addition, (iii) A surface coating layer is strongly bonded through, for example, covalent bonding to a solid of the solid layer. Thus, this feature can effectively act to reduce a thermal resistance in the solid-liquid interface, as a thermal vibration of the solid is approximate to the thermal vibration of the surface coating layer at its root portion.

In the practice of the present invention, the heat exchange member and the heat exchanger and other heat exchange apparatuses using the heat exchange member each can be produced from the materials and in the configurations and forms which are similar to those which are generally applied in the production of conventional heat exchange members and apparatuses with the proviso that the specified surface coating layer described above is applied on the solid layer of the heat exchange member. For example, the heat exchange member may have different configurations such as flat plate member, a laminate member consisting of two or more flat plates or similar composite members, a circular member, a laminate member consisting of two or more circular members or similar composite members, or a fin-shaped member attached to the heat exchange member.

Further, the heat exchange member can be produced from any metal material in accordance with any conventional shaping method. For example, suitable metal material includes, but not restricted to, a metal material having a good heat transfer property such as aluminum, aluminum alloy, for example, aluminum-magnesium alloy, titanium, titanium alloy and others. Suitable shaping method includes, for example, press molding and die casting. If necessary, before formation of a solid layer on a surface of the heat exchange member according to the present invention, the heat exchange member may be subjected to any surface treatment process such as chemical conversion treatment or plating treatment in order to ensure a strong bonding of the solid layer to a body of the heat exchange member.

The heat exchange member supports a solid layer on a surface portion thereof. Especially, it is preferred for the present invention that as a surface coating layer is used in combination with the solid layer, a related portion of the body of the heat exchange member, i.e., a portion of the body to which a surface coating layer is applied, should at least have a solid layer. The solid layer can be produced from any suitable layer-forming material at any desired thickness in accordance with any conventional layer forming method.

For example, the layer-forming material for the solid layer includes, but not restricted to, metals, metal oxides and polymeric materials. As the solid layer receives a surface coating layer (fibrous structures) which has to be strongly fixed to the solid layer, suitable film-forming material includes a metal, for example, a noble metal, especially a metal material having an excellent corrosion resistance, for example, gold (Au), platinum (Pt), or a general metal, for example, iron (Fe), aluminum (Al), copper (Cu) or an alloy or oxide thereof. Using these film-forming materials, the solid layer can be formed in accordance with different types of the film formation method selected depending on the type of the film-forming material and other factors. Suitable film formation method includes, for example, vapor deposition, sputtering and coating. The thickness of the solid layer can be widely varied depending upon the constitution of the heat exchange member, the details of the surface coating layer and other factors, and is generally in the range of about 0.1 nm to 100 μm, preferably in the range of about 0.1 nm to 1 μm.

According to the present invention, a surface coating layer is further applied on a surface of the solid layer described above. The surface coating layer can be formed from any suitable fibrous structures capable of satisfying the requirements described above. In the practice of the present invention, the fibrous structures can be constituted from a wide variety of inorganic or organic materials, however, in view of obtaining good fixation to the solid layer, simplifying the production process and lowering the costs, an organic material, especially an organic compound having a low molecular weight, can be advantageously used in the formation of the fibrous structures. A molecular weight of the low molecular weight organic compound is generally in the range of about 20 to 2,000, preferably about 70 to 600. Further, the organic compound used in the formation of the fibrous structures may be constituted from a single molecule, or it may be constituted from a composite molecule consisting of two or more molecules.

Regardless of the type of the molecule thereof, the organic compound used in the formation of the fibrous structures, i.e., the organic compound having a single molecule and/or a composite molecule, preferably comprises a functional group capable of being adsorbed on a solid of the solid layer in its terminal portion to be fixed to a surface of the solid layer. Suitable functional group includes, but not restricted to, a carboxyl group, a metal salt of a carboxylic acid, a sulfone group, a metal salt of a sulfonic acid, a phosphate group, a metal salt of phosphoric acid, a hydroxyl group, an amide group and others. These functional groups may be used alone or in combination of two or more groups. For example, only one type of the functional group may be used for one heat exchange member, or, if necessary, two or more types of the functional groups may be used in combination for one heat exchange member. That is, when a plurality of fibrous structures are fixed to one solid layer, the functional groups of the fibrous structures may be the same or different.

More especially, the fibrous structures used in the present invention are a member selected from the group consisting of:

thiols represented by the formula (I):

$$HS—X—Y \quad (I),$$

disulfids represented by the formula (II):

$$\begin{array}{l} S\text{-}X\text{-}Y \\ | \\ S\text{-}X\text{-}Y \end{array} \quad (II)$$

and amines represented by the formula (III):

$$NH—X—Y \quad (III)$$

in which X represents an alkane group, for example, $—(CH_2)_n—$, $—(CH_2)_m—CH—(CH_2)_n—$ and $—(CH_2)_m—C{\equiv}C—(CH_2)_n$ wherein n is an integer of about 1 to 150 and m is an integer of about 1 to 150, and Y represents a functional group, for example, a carboxyl group, a metal salt of a carboxylic acid, a sulfone group, a metal salt of a sulfonic acid, a phosphate group, a metal salt of phosphoric acid, a hydroxyl group and an amide group.

In one preferred example of the fibrous structures described above, suitable thiols include, for example, alkanethiol $HS—(CH_2)_n—CH_3$ and mercaptocarboxylic acid $HS—(CH_2)_n—COOH$. Disulfides include, for example, the following compound.

$$\begin{array}{l} S—(CH_2)_n—CH_3 \\ | \\ S—(CH_2)_n—CH_3 \end{array}$$

Further, amines include, for example, $NH—(CH_2)_n—CH_3$.

The surface coating layer of the present invention consisting of an aggregate of the fibrous structures can be formed from the layer-forming materials described above using different layer formation methods selected depending upon various factors such as a composition of the material forming the surface coating layer and a bonding power to the solid layer, followed by fixing to the solid layer. Suitable layer formation method includes, for example, vapor deposition, spattering, coating and dipping. For example, the surface coating layer may be preferably formed using the method based on the method of forming a self-assembled layer. For example, after preparation of the fibrous structures which preferably comprise an organic compound, the fibrous structures are dissolved in a suitable solvent, and then the separately prepared heat exchange member having the solid layer is dipped in the solution prepared in the above step. Next, the heat exchange member is pulled from the dipping solution, and a dipping solution adhered to a surface of the heat exchange member is rinsed with a suitable solvent. Thus, the heat exchange member having a surface coating layer strongly bonded to a surface of the solid layer of the heat exchange member can be obtained. In the resulting heat exchange member, a thickness of the surface coating layer can be widely varied depending upon the details of the surface coating layer, the types of the layer formation method used and other factors, and is generally in the range of about 0.1 nm to 100 μm, preferably in the range of about 0.1 nm to 1 μm.

Figure 5:
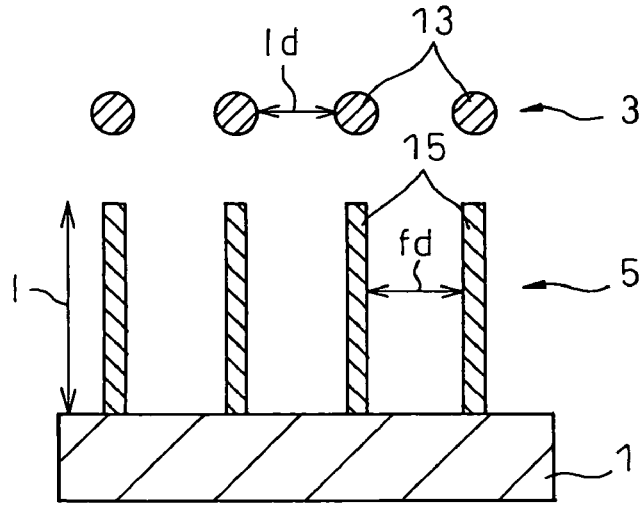
FIG. 5 is an illustration showing an embodiment of the surface coating layer preferred in the practice of the present invention.

FIG. 5 illustrates one embodiment of the surface coating layer preferred in the practice of the present invention. In the illustrated heat exchange member, 1. One end of the fibrous structures 15 is fixed on a surface of the solid layer 1 and another end thereof is positioned in a side of the liquid layer 3.

2. The fibrous structures 15 are independently disposed with each other.

3. An interaction fd of the fibrous structures between the adjacent fibrous structures 15 is the same as the interaction ld of the liquid molecules between liquid molecules 13 constituting the liquid layer 3.

4. A length l of the fibrous structures 15 is not less than an average intermolecular distance between liquid molecules 13 constituting the liquid layer 3.

Further, in the heat exchange member shown in FIG. 5, the fibrous structures 15 are fixed on a surface of the solid layer 1 in such a manner that they are substantially perpendicular to a surface of the solid layer 1. In other words, the fibrous structures 15 are in the form of a straight chain-like structure and thus they have no bending or flexion portion in a length thereof. Further, the fibrous structures 15 have the substantially same length. In this instance, the length of the fibrous structures 15 is preferred to be substantially the same as the average intermolecular distance between liquid molecules 13 constituting the liquid layer 3. The formation of the fibrous structures 15 from molecules having a straight chain is preferred, as it can reduce a damping of the vibration during transfer of the vibration of the solid to the liquid. In addition, the constitution of one fibrous structure 15 from one molecule is also preferred, as it can reduce a damping of the vibration during transfer of the vibration of the solid to the liquid.

Figure 6:
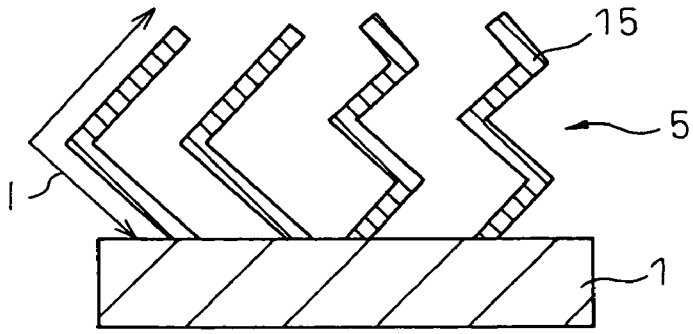
FIG. 6 is an illustration showing another embodiment of the surface coating layer preferred in the practice of the present invention.

FIG. 6 illustrates another embodiment of the surface coating layer preferred in the practice of the present invention. In the illustrated heat exchange member, the fibrous structures 15 have one and two bending portions in the length thereof, as is illustrated. Further, if necessary, although not illustrated, the fibrous structures 15 may have three or more bending portions in the length thereof. In addition, it should be noted that, if necessary, although not illustrated, at least a part the fibrous structures may have a bending portion or, alternatively, at least a part of the fibrous structures 15 may have one or more bending portions to form a fibrous bending structure. That is, the fibrous straight chain-like structure and the fibrous bending structure may be included in combination in the heat exchange member. Use of the fibrous bending structure in addition to the fibrous straight chain-like structure will enable to give a vibration state approximate to the liquid to a tip portion of the fibrous structures.

Figure 7:
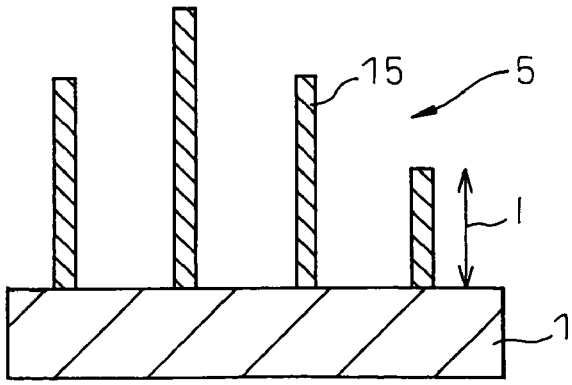
FIG. 7 is an illustration showing another embodiment of the surface coating layer preferred in the practice of the present invention.
Figure 8:
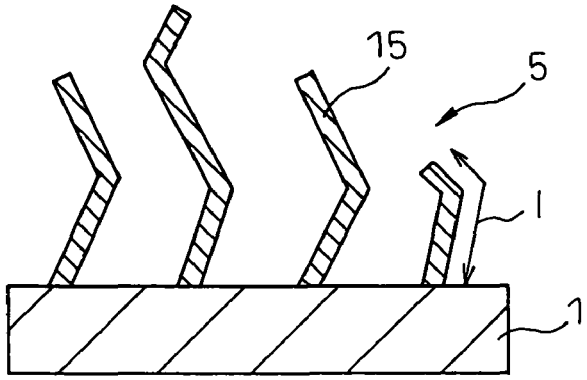
FIG. 8 is an illustration showing another embodiment of the surface coating layer preferred in the practice of the present invention.

FIGS. 7 and 8 illustrate other embodiments of the surface coating layer preferred in the practice of the present invention. FIG. 7 illustrates the fibrous straight chain-like structures 15, and FIG. 8 illustrates the fibrous bending structures 15. In the heat exchange members illustrated in FIGS. 7 and 8, the fibrous structures 15 have different lengths, but the shortest length l of the fibrous structures 15 is at least identical with the average intermolecular distance between liquid molecules constituting the liquid layer. When the lengths of the fibrous structures are varied and the shortest length of the fibrous structures is at least identical with the average intermolecular distance between liquid molecules as is illustrated, it becomes possible to effectively transfer a thermal vibration, as a vibration of the fibrous structures protruded to the liquid layer can be more approximated to the vibration state of the liquid.

Figure 9:
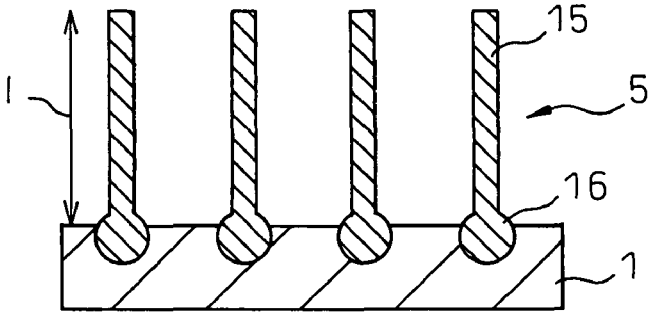
FIG. 9 is an illustration showing another embodiment of the surface coating layer preferred in the practice of the present invention.

FIG. 9 illustrates another embodiment of the surface coating layer preferred in the practice of the present invention. In the illustrated heat exchange member, the fibrous structures 15 have on a side of the solid layer 1 thereof a functional group 16 having a property of being adsorbed on the solid such as —SH, —COOH, —$NH_3$, —$PO_3$ and the like. The presence of these functional groups is effective to ease a transfer of the vibration of the solid to the fibrous structures 15. In addition, when the fibrous structures 15 each is constituted from the molecules having a straight chain or one fibrous structure 15 is formed from a single molecule, it becomes possible to reduce a damping of the vibration during transfer of the vibration of the solid to the liquid.

Figure 10:
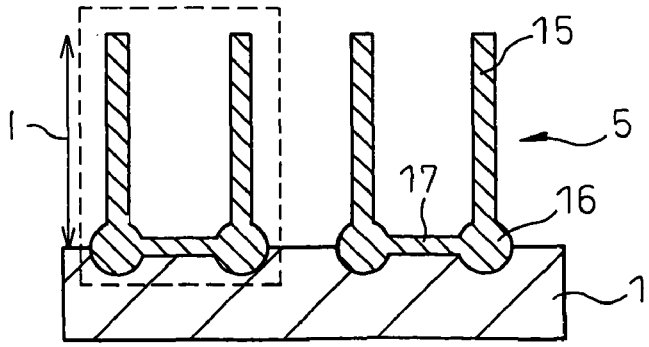
FIG. 10 is an illustration showing another embodiment of the surface coating layer preferred in the practice of the present invention.

FIG. 10 illustrates another embodiment of the surface coating layer preferred in the practice of the present invention. In the illustrated heat exchange member, two fibrous structures 15 are formed from one molecule, as is illustrated with a dotted line in FIG. 10. In this connection, it should be noted that, although not illustrated, three or more fibrous structures 15 may be formed from one molecule. In the illustrated instance, the bonding between the molecules to form one molecule can be carried out by utilizing any bonding such as —S—S— bond. As a result, it becomes possible to dispose the fibrous structures 15 on a surface of the solid layer 1 at a high density and with a high adsorption power.

Figure 11:
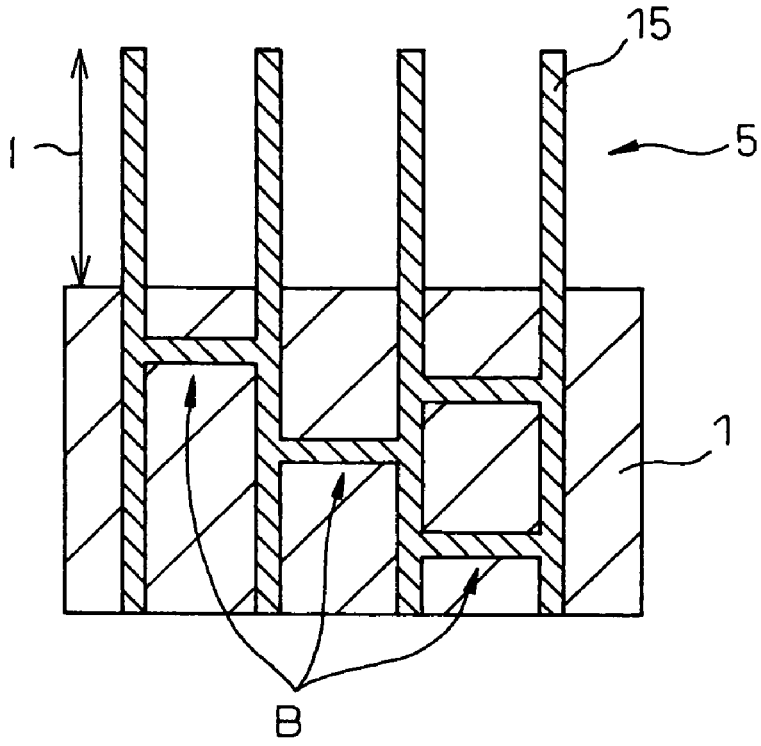
FIG. 11 is an illustration showing another embodiment of the surface coating layer preferred in the practice of the present invention.

FIG. 11 illustrates another embodiment of the surface coating layer preferred in the practice of the present invention. In the illustrated heat exchange member, an end portion of the fibrous structures 15 is deeply embedded in the solid layer 1, as is illustrated. Further, as is shown with an arrow "B", an end portion of the fibrous structures 15 each is bonded with each other through any suitable bond such as covalent bond, ionic bond and metallic bond. Presence of such a bond of the fibrous structure in the solid layer is effective to transfer the vibration of the solid layer 1 to the fibrous structures 15 without damping of the vibration.

Figure 12:
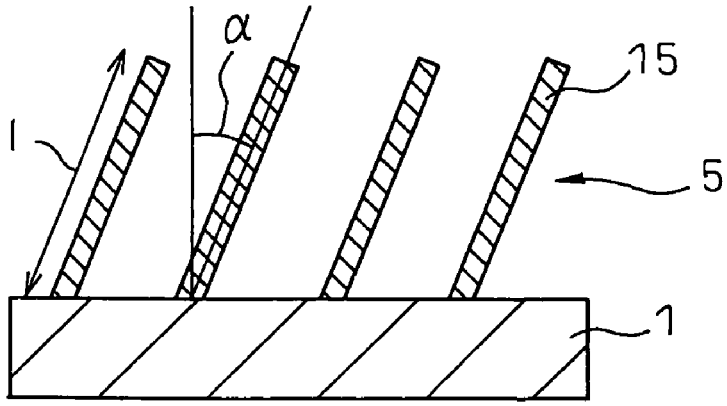
FIG. 12 is an illustration showing another embodiment of the surface coating layer preferred in the practice of the present invention.

FIG. 12 illustrates another embodiment of the surface coating layer preferred in the practice of the present invention. In the illustrated heat exchange member, the fibrous structures 15 are fixed on a surface of the solid layer 1 at an inclined angle of $\alpha$ degree with regard to a perpendicular surface to the surface of the solid layer 1. In this connection, it should be noted that in the illustrated instance, all the fibrous structures 15 have been inclined with regard to the solid layer 1, but, if necessary, only some of the fibrous structures 15 may be inclined, while the remainder of the fibrous structures 15 are disposed in the direction of perpendicular to the surface of the solid layer 1. When the inclined disposal of the fibrous structures 15 is made on the solid layer 1, the effects of stably forming a laminar structure from the fibrous structures 15 will be expected. The inclined angle $\alpha$ can be widely varied, but generally it is in the range of about 0 to 45 degree.

Figure 13:
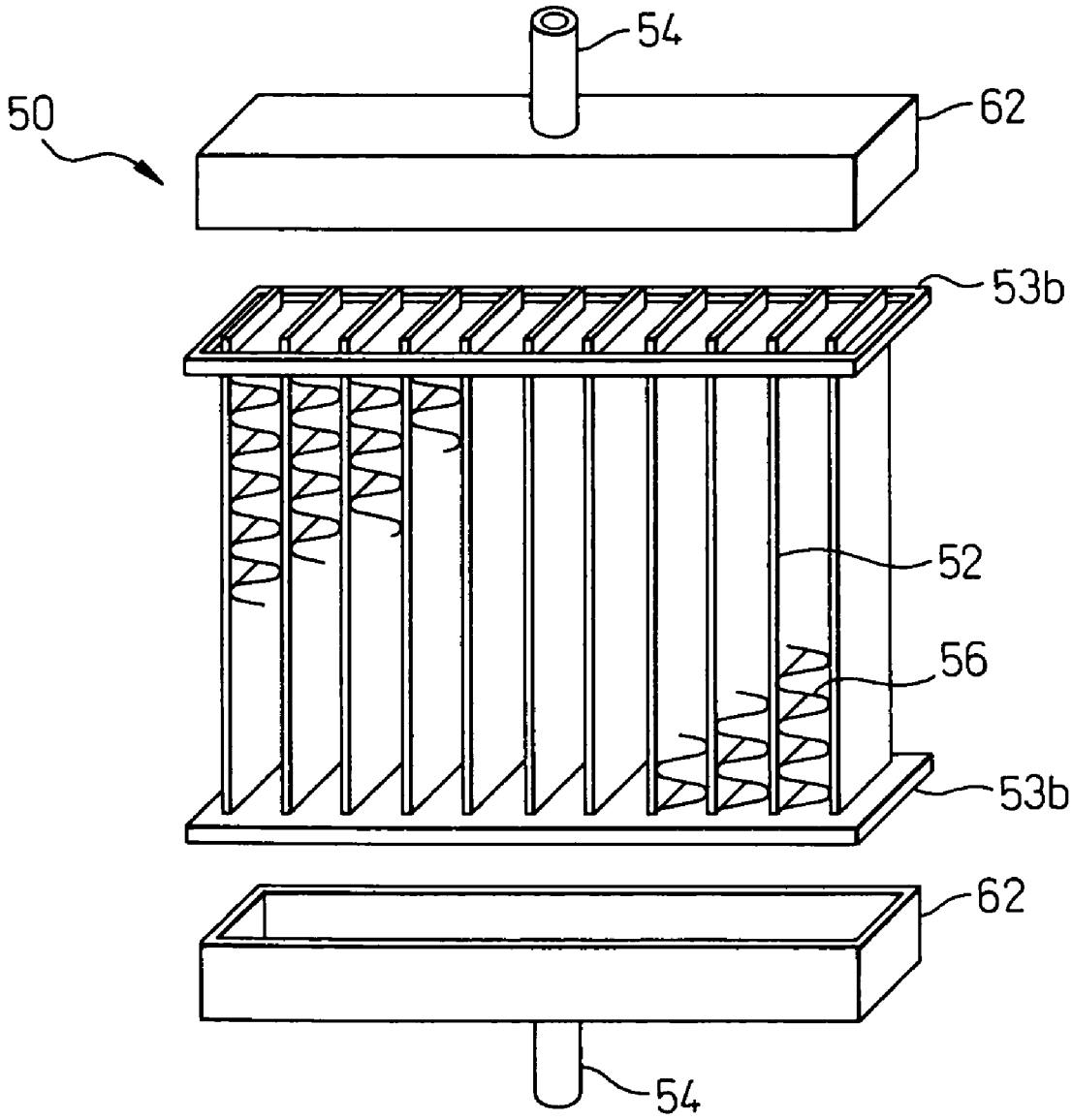
FIG. 13 is a perspective view showing one example of the heat exchanger using the heat exchanging member according to the present invention.

FIG. 13 illustrates an embodiment of the heat exchanger using the heat exchange member of the present invention. The illustrated heat exchanger is a heat exchanger capable of using a so-called "LLC (Long Life Coolant)" as a cooling water, and thus it can be utilized in automobiles. The heat exchange 50 comprises core portion, and the core portion comprises a plurality of parallel tubes 52 made of aluminum, and a tube plate 53*b* through which both ends of the tube 52 are passed under the liquid-tight condition. The tube plate 53*b* is coupled with a body 62 of the tank having one open end to form a tank. Each of the tank is provided with an inlet or outlet pipe 54. The tube 52 each has a corrugated fin 56 made of aluminum on an outer surface thereof. The fin 56 is attached to the tube 52 through brazing. Although not illustrated, the tube 52 and the corrugated fin 56 have a solid layer (Au layer)

and a surface coating layer (alkanethiol layer) according to the present invention in their surface to be contacted with the LLC.

EXAMPLES

The present invention will be further described with reference to the examples thereof.

Production and Evaluation of Thermal Exchanger

Two flat plates for use in the test were produced from the plate made of aluminum. An alkanethiol was applied to one test plate in accordance with the method described above to form a surface coating layer having a thickness of about 2.5 nm. Then, the two flat plates were disposed so that they are opposed as is illustrated in FIG. 4(B), followed by introducing toluene between the opposed flat plates. Thereafter, a simulation test was carried out by applying a difference in the temperature to the flat plates. As a result of the simulation test, the test results plotted in FIG. 4(A) were obtained. As is shown in the graph of FIG. 4(A), a side having no surface coating layer of the flat plate exhibited a remarkable increase of the thermal resistance, whereas such a remarkable increase of the thermal resistance could not been attained in a side having a surface coating layer of the flat plate. As is shown, a thermal resistance was increased with a very small curve in the side having a surface coating layer of the solid layer due to presence of the surface coating layer. Further, this exhibits that as a result of inhibiting an increase of the thermal resistance according to the present invention, it becomes possible to realize a very excellent cooling performance in the heat exchanger.

The invention claimed is:

1. A heat exchange member comprising a liquid layer and a solid layer capable of conducting a heat exchange reaction with the liquid layer upon their solid-liquid contact at an interface between the solid layer and the liquid layer, wherein said solid layer further comprises, on a surface thereof which is contacted with the liquid layer, a surface coating layer capable of reducing a difference of the vibration between a thermal vibration of the solid and a thermal vibration of the liquid, said surface coating layer comprises a plurality of fibrous structures aligned on a surface of the solid layer;

said fibrous structures each has one end which is fixed on a surface of the solid layer and another end which is a free end and is contacting with the liquid layer, and are aligned independently with each other, a distance between the adjacent fibrous structures is substantially the same as a distance between molecules of the liquid constituting the liquid layer, and a length of said fibrous structures is identical with or is not less than an average intermolecular distance between molecules of the liquid constituting the liquid layer.

2. The heat exchange member according to claim 1, wherein:

said fibrous structures are substantially perpendicularly fixed on a surface of the solid layer.

3. The heat exchange member according to claim 1, wherein at least a part of said fibrous structures is fixed on a surface of the solid layer at an inclined angle of $\alpha$ degree with regard to a perpendicular surface to the surface of the solid layer.

4. The heat exchange member according to claim 1, wherein:

said fibrous structures have substantially the same length which is at least identical with the average intermolecular distance between molecules of the liquid constituting the liquid layer.

5. The heat exchange member according to claim 1, wherein said fibrous structures have different lengths with the proviso that the shortest length of the fibrous structures is at least identical with the average intermolecular distance between molecules of the liquid constituting the liquid layer.

6. The heat exchange member according to claim 1, wherein:

said fibrous structures have a configuration of straight chains which has no bending portion in the length of the chains.

7. The heat exchange member according to claim 1, wherein said fibrous structures have a configuration of straight chains, and at least a part of said fibrous structures have one or more bending portions in the length of the chains.

8. The heat exchange member according to claim 1, wherein:

said fibrous structures each comprises one molecule or at least a part of said fibrous structures comprises a composite molecule which is constituted from two or more molecules.

9. The heat exchange member according to claim 8, wherein the molecule and/or the composite molecule of said fibrous structures further comprises on an end portion fixed to a surface of the solid layer a functional group having a property of being adsorbed on a solid.

10. The heat exchange member according to claim 9, wherein the functional group is a member selected from the group consisting of a carboxyl group, a metal salt of a carboxylic acid, a sulfone group, a metal salt of a sulfonic acid, a phosphate group, a metal salt of phosphoric acid, a hydroxyl group and an amide group.

11. The heat exchange member according to claim 1, wherein:

said solid layer comprises a metal, a metal oxide or a polymeric material.

12. The heat exchange member according to claim 11 said fibrous structures are embedded in the solid layer, and are bonded with the solid layer with each other through their covalent bonding, ionic bonding or metallic bonding.

13. A heat exchange member comprising a liquid layer and a solid layer capable of conducting a heat exchange reaction with the liquid layer upon their solid-liquid contact at an interface between the solid layer and the liquid layer, wherein said solid layer further comprises, on a surface thereof which is contacted with the liquid layer, a surface coating layer capable of reducing a difference of the vibration between a thermal vibration of the solid and a thermal vibration of the liquid, said surface coating layer comprises a plurality of fibrous structures aligned on a surface of the solid layer;

said fibrous structures are a member selected from the group consisting of:

thiols represented by the formula (I):

$$HS—X—Y, \quad (I)$$

disulfides represented by the formula (II):

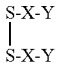

(II)

and amines represented by the formula (III):

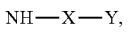

(III)

wherein X represents an alkane group and Y represents a functional group.

14. The heat exchange member according to claim 1, wherein the solid layer comprises a gold and the liquid layer comprises toluene.

15. A heat exchange apparatus comprises a heat exchange member according to claim 1.

16. The heat exchange apparatus according to claim 15 which is a heat exchanger for use in automobiles.

* * * * *

UNITED STATES PATENT AND TRADEMARK OFFICE

CERTIFICATE OF CORRECTION

PATENT NO. : 8,256,502 B2
APPLICATION NO. : 12/156680
DATED : September 4, 2012
INVENTOR(S) : Touru Kawaguchi et al.

It is certified that error appears in the above-identified patent and that said Letters Patent is hereby corrected as shown below:

In the Title Page:

Item (73), Assignee: "Denso Corporation, Kariya (JP)" should be

-- Denso Corporation, Kariya-city (JP);

The University of Tokyo, Tokyo (JP) --

Signed and Sealed this
Fourth Day of June, 2013

Teresa Stanek Rea

Teresa Stanek Rea
*Acting Director of the United States Patent and Trademark Office*